US010157721B2

(12) United States Patent
Netherton

(10) Patent No.: US 10,157,721 B2
(45) Date of Patent: Dec. 18, 2018

(54) ELECTRICAL BREAKER REAR SIDE ACTUATOR

(71) Applicant: DEA Incorporated, Spokane Valley, WA (US)

(72) Inventor: Edward E. Netherton, Troy, MT (US)

(73) Assignee: DEA Incorporated, Spokane Valley, WA (US)

( * ) Notice: Subject to any disclaimer, the term of this patent is extended or adjusted under 35 U.S.C. 154(b) by 0 days.

(21) Appl. No.: 15/482,599

(22) Filed: Apr. 7, 2017

(65) Prior Publication Data

US 2017/0294283 A1 Oct. 12, 2017

Related U.S. Application Data

(60) Provisional application No. 62/319,679, filed on Apr. 7, 2016.

(51) Int. Cl.
*H01H 3/04* (2006.01)
*H01H 3/20* (2006.01)
(Continued)

(52) U.S. Cl.
CPC ..... *H01H 71/56* (2013.01); *H01H 9/22* (2013.01); *H01H 9/281* (2013.01); *H01H 2071/565* (2013.01)

(58) Field of Classification Search
CPC .. H01H 9/00; H01H 9/02; H01H 9/06; H01H 9/0264; H01H 9/20; H01H 9/282;
(Continued)

(56) References Cited

U.S. PATENT DOCUMENTS 5,422,453 A * 6/1995 Smith ..... H01H 3/3021 200/329
5,838,219 A 11/1998 Du et al.
(Continued)

FOREIGN PATENT DOCUMENTS

BR 102012003947 A1 8/2016
CN 103117514 A 5/2013
EP 2940705 A1 11/2015

OTHER PUBLICATIONS

Eaton Powering Business Worldwide; Variable Operation—Toggle, Turn, Automatic Operation; http://www.moeller.net/en/products_solutions/power_distribution/power_communication/circuit_breaker_new1600a_start/circuit_breaker_new_variable_op.jsp retrieved from the Internet Mar. 31, 2017.

*Primary Examiner* — Anthony R. Jimenez
(74) *Attorney, Agent, or Firm* — Randall Danskin P.S.

(57) ABSTRACT

A breaker actuator includes a slide plate, at least one actuator lever, and a drive plate. The slide plate is linearly movable. The actuator lever is rotatable about a pivot. The actuator lever engages the slide plate and rotational movement of the actuator lever is actuatable by linear movement of the slide plate. The drive plate is moveable between an off position and an on position and is actuatable by rotational motion of the at least one actuator lever. A method for actuating a breaker includes moving a slide plate linearly from a first position to a second position, rotating at least one actuator lever about a pivot from a first position to a second position by the linear movement of the slide plate, and moving a drive plate in front of an electrical breaker from an off position to an on position by the rotational motion of the actuator lever.

20 Claims, 4 Drawing Sheets

(51) Int. Cl.
*H01H 71/56* (2006.01)
*H01H 9/22* (2006.01)
*H01H 9/28* (2006.01)

(58) Field of Classification Search
CPC ..... H01H 9/22; H01H 9/28; H01H 19/00; H01H 19/02; H01H 19/04; H01H 71/00; H01H 71/02; H01H 71/10; H01H 71/52; H01H 71/521; H01H 73/00; H01H 73/02; H01H 73/06; H01H 73/10; H01H 2221/00; H01H 2221/016; H01H 2221/024; H01H 1/52; H01H 3/02; H01H 3/20; H01H 2300/56; H05K 7/18; G05G 1/54
USPC ..... 200/50.34, 50.24, 50.11, 51 R, 51.02, 200/425, 564, 566, 567, 573, 318, 318.2, 200/321, 329, 330, 332.1, 335–338, 331
See application file for complete search history.

(56) References Cited

U.S. PATENT DOCUMENTS

| | | | |
|---|---|---|---|
| 5,902,973 | A | 5/1999 | Ramey et al. |
| 7,368,675 | B2 | 5/2008 | Ishido et al. |
| 7,399,934 | B2 | 7/2008 | Emura et al. |
| 7,943,873 | B2 | 5/2011 | Gopikrishnan Babu et al. |
| 8,780,534 | B2 | 7/2014 | Gibbons |

* cited by examiner

ELECTRICAL BREAKER REAR SIDE ACTUATOR

CROSS REFERENCE TO RELATED APPLICATIONS

The present application claims the benefit of priority under 35 U.S.C. § 119 to U.S. Provisional Application No. 62/319,679, filed Apr. 7, 2016, entitled "Electrical Breaker Rear Side Actuator," the disclosure of which is incorporated by reference in its entirety.

TECHNICAL FIELD

The embodiments described herein relate generally to a method and system for actuating an electrical breaker.

BACKGROUND

Known electrical breakers are used to break an electrical circuit. As used herein, the term "electrical breaker" refers to overcurrent protective devices, commonly referred to as circuit breakers, such as molded case circuit breakers that automatically trip to protect an electrical circuit from damage due to short circuiting or current overload, supplementary protectors, and manually operated switches that break an electrical circuit. These devices are typically mounted in an electrical panel and include a lever to be accessed by an operator. However, many known electrical breakers are actuated by direct contact with the electrical breaker. As a result, the risk of shock and/or serious injury to an operator is increased.

Other known electrical breakers may include a handle system that attaches over the lever of the electrical breaker. The handle system may substantially increase the depth of the electrical breaker. Known cable type actuators may tend to bind over time. Other problems and disadvantages of known breakers exist.

SUMMARY

An embodiment of a breaker rear side actuator includes a slide plate, at least one actuator lever, and a drive plate. The slide plate is linearly movable between a first position and a second position. The at least one actuator lever is rotatable about a pivot. The at least one actuator lever engages the slide plate and rotational movement of the at least one actuator lever is actuatable by linear movement of the slide plate. The drive plate engages the at least one actuator lever and is configured to engage an operator handle of an electrical breaker. The drive plate is moveable between an off position and an on position and is actuatable by rotational motion of the at least one actuator lever.

The at least one actuator lever may be two actuator levers and each of the two actuator levers engages the drive plate. The slide plate may include an elongate slot extending approximately normal to the linear movement of the slide plate. The actuator may include a rotatable crank arm with a crank pin, the crank pin being positioned within the elongate slot. The actuator may include a shaft having a first end and a second end, the crank arm being connected to and rotatable with the first end of the shaft. The actuator may include a handle connected to and rotatable with the second end of the shaft. The actuator may include a base plate and a riser plate. The slide plate may be positioned between the base plate and the riser plate.

An embodiment of a breaker rear side actuator includes an electrical breaker, a slide plate, and at least one actuator lever. The electrical breaker has a first side, a second side, and an operator handle on the first side. The first side may be opposite the second side. The slide plate is linearly movable between a first position and a second position. The slide plate is positioned on the second side of the electrical breaker. The at least one actuator lever is rotatable about a pivot. The at least one actuator lever engages the slide plate and is connected to the operator handle of the electrical breaker. Rotational movement of the at least one actuator lever is actuatable by linear movement of the slide plate.

The at least one actuator lever may be two actuator levers and each of the two actuator levers may engage the drive plate. The actuator may include a drive plate engaging the operator handle of the electrical breaker. The at least one actuator lever may be connected to the operator handle through the drive plate. The slide plate may include an elongate slot extending approximately normal to the linear movement of the slide plate. The actuator may include a rotatable crank arm with a crank pin, the crank pin being positioned within the elongate slot. The actuator may include a shaft having a first end and a second end. The crank arm is connected to and rotatable with the first end of the shaft. The actuator may include a handle connected to and rotatable with the second end of the shaft. The actuator may include a base plate and a riser plate, wherein the slide plate is positioned between the base plate and the riser plate.

An embodiment of a method for actuating a breaker includes moving a slide plate linearly from a first position to a second position, engaging at least one actuator lever with the slide plate, the at least one actuator lever rotating about a pivot from a first position to a second position as actuated by the linear movement of the slide plate, and engaging a drive plate in front of an electrical breaker with the actuator lever, the drive plate moving from an off position to an on position as actuated by the rotational motion of the actuator lever.

The electrical breaker may be positioned between the slide plate and the drive plate. The method may include moving the slide plate linearly from the second position to the first position, rotating the at least one actuator lever about the pivot from the second position to the first position as actuated by the linear movement of the slide plate from the second position to the first position, and moving the drive plate from the on position to the off position as actuated by the rotational motion of the actuator lever from the second position to the first position. The at least one actuator lever may be two actuator levers, each of the two actuator levers engaging the drive plate. The method may include rotating a crank arm about an axis of rotation, the crank arm including a crank pin moving in a circular motion around the axis of rotation. The method may include engaging an elongate slot of the slide plate with the crank pin, the slide plate moving linearly from the first position to the second position as actuated by the circular motion of the crank pin.

An embodiment of a method for actuating a breaker includes moving a slide plate linearly from a first position to a second position, rotating two actuator levers about respective pivots due to engagement with the slide plate, the two actuator levers being connected to an operator handle of an electrical breaker, and switching the electrical breaker from an off position to an on position by the rotational motion of the two actuator levers.

The method may include moving the slide plate linearly from the second position to the first position, rotating the two actuator levers about the respective pivots due to engagement with the slide plate, and switching the electrical breaker from the on position to the off position by the rotational motion of the two actuator levers. The method may include rotating a crank arm about an axis of rotation, the crank arm including a crank pin moving in a circular motion around the axis of rotation. The method may include engaging an elongate slot of the slide plate with the crank pin, the slide plate moving linearly from the first position to the second position as actuated by the circular motion of the crank pin.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

Some embodiments are described below with reference to the following accompanying drawings.

DETAILED DESCRIPTION

Figure 1:
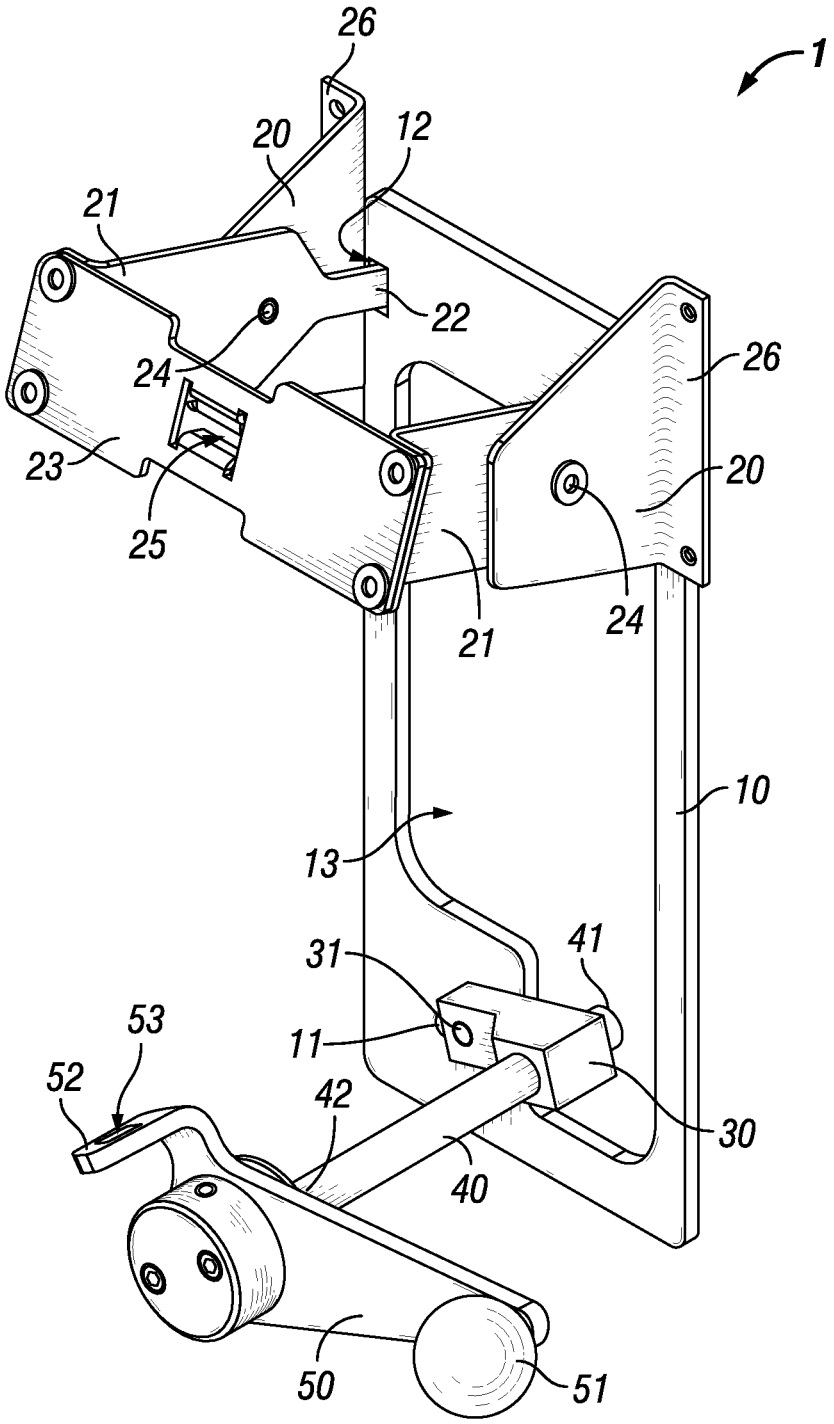
FIG. 1 shows an isometric view of selected components of an embodiment of a breaker rear side actuator.

The systems and methods herein may overcome at least some of the problems and disadvantages discussed above. The features and benefits of particular, individual systems and methods herein may also be used in combination with other systems and methods discussed herein even though not specifically indicated otherwise.

Described herein are embodiments of a breaker rear side actuator for actuating an electrical breaker. An electrical breaker is designed to disrupt the current flowing through a circuit. In the on position, current is allowed to flow through the circuit. In the off position, current is not allowed to flow through the circuit. An operator handle of the electrical breaker pivots between the on and off positions. The electrical breaker may include a tripped position that shows an operator when the electrical breaker has been automatically tripped rather than manually switched.

The breaker rear side actuator engages the electrical breaker handle from a rear side of the electrical breaker. An operator may operate the electrical breaker without coming into direct contact with the electrical breaker. The electrical breaker may be a three-phase, high-power, molded-case electrical breaker, such as might be installed in portable underground substations (mine power centers) and "Terminator" style disconnect panels. A person of ordinary skill in the art having the benefit of this disclosure would appreciate that embodiments may be adapted for use with other types of electrical breakers. The breaker rear side actuator may be installed in a front mounted door or fixed front panel of an electrical breaker enclosure.

An embodiment of an electrical breaker actuator includes a slide plate positioned behind an electrical breaker on a first side of the electrical breaker and an operator handle of the electrical breaker on a second side of the electrical breaker. The first side may be opposite the second side. The slide plate is slidable between a first position and a second position. At least one actuator lever is connected to the operator handle of the electrical breaker and engaged with the slide plate so that sliding the slide plate between the first and second positions actuates rotational movement of the at least one actuator lever and moves the operator handle of the electrical breaker. The at least one actuator lever may be a pair of actuator levers. The actuator may include a drive plate engaging the operator handle of the electrical breaker. The at least one actuator lever may be connected to the operator handle through the drive plate.

The slide plate may include an elongate slot extending approximately normal to the linear movement of the slide plate. The electrical breaker actuator may include a rotatable crank arm with a crank pin, the crank pin being positioned within the elongate slot. Rotation of the crank arm actuates the sliding motion of the slide plate. The electrical breaker actuator may include a shaft having a first end and a second end, the crank arm being connected to and rotatable with the first end of the shaft. The electrical breaker actuator may include a handle connected to and rotatable with the second end of the shaft. The slide plate may be positioned between a base plate and a riser plate.

Figure 2:
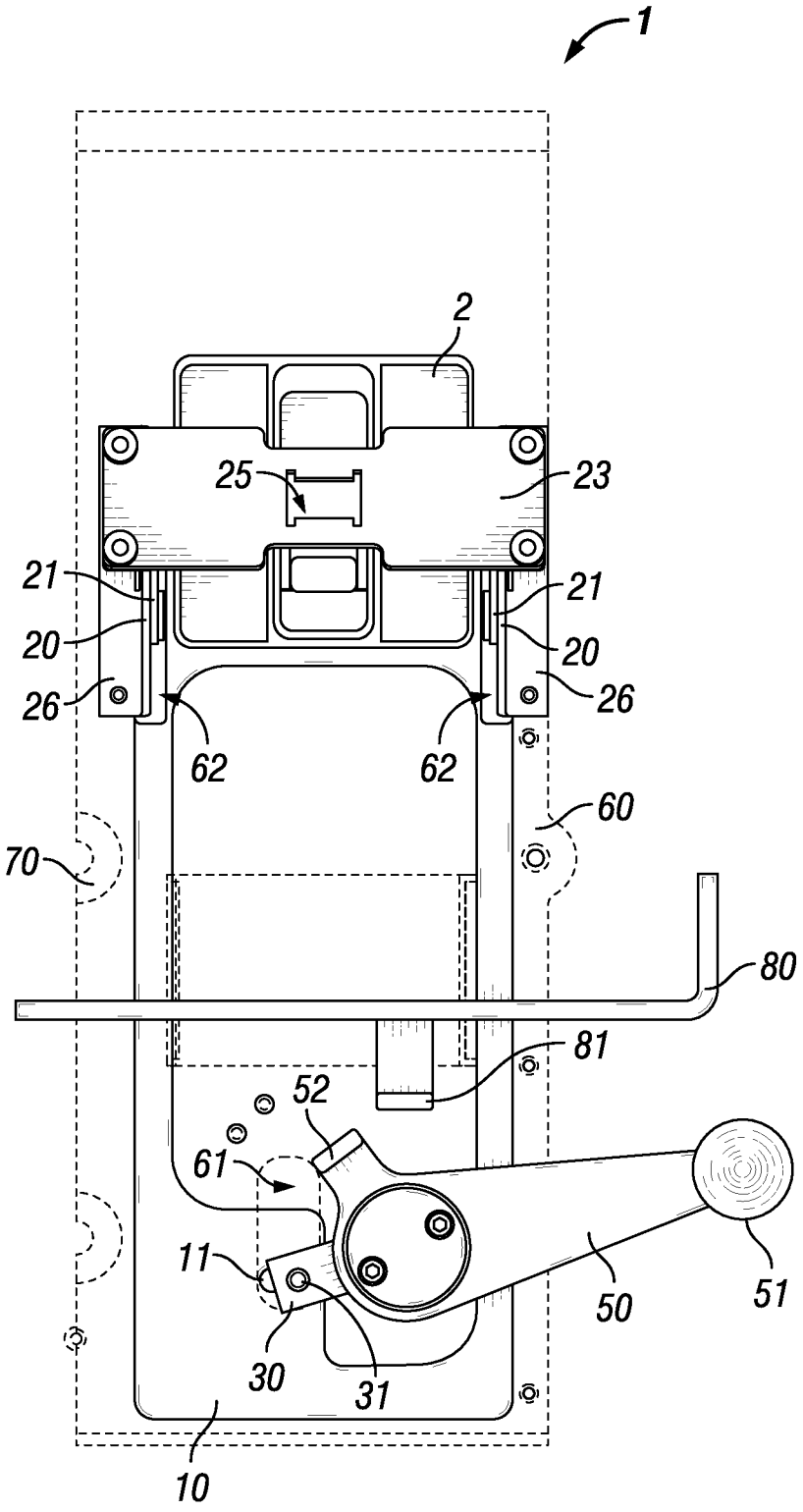
FIG. 2 shows a front view of the FIG. 1 embodiment with a lockout bar, riser plate, and base plate.

FIG. 1 shows an embodiment of a breaker rear side actuator 1. Breaker rear side actuator 1 includes a slide plate 10, at least one actuator lever 21, a drive plate 23, a crank arm 30, a shaft 40, and a handle 50. Breaker rear side actuator 1 may include a riser plate 60, a base plate 70, and a lockout bar 80 as shown in FIG. 2. As shown, the at least one actuator lever 21 may be a pair of actuator levers 21. Actuator lever 21 engages slide plate 10. Actuator lever 21 may also engage drive plate 23. Slide plate 10 exhibits a range of sliding linear motion. Actuator lever 21 exhibits a range of rotational motion about a pivot 24 actuated by the range of sliding motion of slide plate 10.

Drive plate 23 is configured to engage the operator handle of an electrical breaker 2. Drive plate 23 exhibits a range of motion between an off position and an on position actuated by the range of rotational motion of actuator lever 21. Drive plate 23, slide plate 10, and actuator lever 21 are sized and positioned sufficiently to permit electrical breaker 2 (shown in FIG. 2) to be placed between drive plate 23 and slide plate 10 with drive plate 23 engaging an operator handle of electrical breaker 2. The off and on positions are selected to turn electrical breaker 2 off and on as a result of the sliding motion of slide plate 10.

Slide plate 10 includes an elongate slot 11 and at least one lever aperture 12. The elongate slot 11 extends approximately normal to the linear movement of slide plate 10. Elongate slot 11 is configured to receive a crank pin 31 to create a bell crank motion between crank arm 30 and slide plate 10. Slide plate 10 includes two lever apertures 12 positioned on opposite sides of slide plate 10. The two lever apertures 12 may be symmetrically positioned. Lever apertures 12 are shaped to receive a portion of actuator levers 21 therein. Slide plate 10 is moveable through its range of motion between a first position and a second position. The first position may be a raised position that corresponds to an off position of electrical breaker 2. The second position may be a lowered position that corresponds to an on position of electrical breaker 2. Slide plate 10 may be constrained to linear movement within a plane formed by slide plate 10. Slide plate 10 may include a middle aperture 13 shaped to accommodate a rear end 41 of shaft 40 while permitting movement of slide plate 10 between its first and second positions.

Actuator lever(s) 21 is rotatable through its range of motion between a first position and a second position. The first position may be a lowered position that corresponds to an off position of electrical breaker 2. The second position may be a raised position that corresponds to an on position of electrical breaker 2. Actuator levers 21 each include a first end 22 configured to engage slide plate 10 and a second end 27 (shown in FIG. 4) configured to engage drive plate 23. In some embodiments, second ends 27 of actuator levers 21 may directly contact the operator handle of electrical breaker 2. First ends 22 of actuator levers 21 are engaged with lever apertures 12 of slide plate 10 such that movement of slide plate 10 causes actuator levers 21 to rotate about respective pivots 24. In other words, pivot 24 is positioned between first end 22 and second end 27 of actuator lever 21.

Actuator lever 21 connects with the operator handle of electrical breaker 2 on one side of pivot 24 and engages slide plate 10 on the other side of pivot 24. As shown, first end 22 of actuator lever 21 may be of reduced size to be received within lever apertures 12 of slide plate 10. In other embodiments, actuator levers 21 may be connected to slide plate 10 via a pin, or other connection allowing rotation of actuator levers 21 as slide plate 10 moves in a linear direction. The two actuator levers 21 are positioned on each side of electrical breaker 2 (shown in FIG. 2). The two actuator levers 21 provide a symmetrical motion and force that is transmitted evenly to the operator handle of electrical breaker 2. Drive plate 23 may engage each of the two actuator levers 21.

Drive plate 23 is connected to second ends 27 (shown in FIG. 4) of actuator levers 21, for example, by screws. Second ends 27 of actuator levers 21 may be flanged as shown to provide an expanded mounting surface. Drive plate 23 links movement of actuator levers 21 to the operator handle of electrical breaker 2 so that movement of actuator levers 21 also moves the operator handle of electrical breaker 2. Drive plate 23 may include a rectangular opening 25 shaped to receive the operator handle of electrical breaker 2 when breaker rear side actuator 1 is installed on electrical breaker 2. Rectangular opening 25 of drive plate 23 may fit the operator handle of electrical breaker 2 close enough to not allow any significant amount of play, but loose enough to allow a non-binding movement between the operator handle of electrical breaker 2 and drive plate 23.

Actuator levers 21 are rotatable about a midsection of actuator levers 21. Actuator levers 21 may be mounted upon pivot mounts 20. Pivot mounts 20 may include flanged ends 26 to facilitate installation of pivot mounts 20 to a riser plate 60 (shown in FIG. 2). Pivot mounts 20 each include a pivot 24, such as a bolt, pin, or trunnion, for attachment of one of actuator levers 21 thereto. Linear movement of slide plate 10 is evenly transferred into first ends 22 of actuator levers 21 as slide plate 10 carries first ends 22 of actuator levers 21 within the lever apertures 12 of slide plate 10. Actuator levers 21 each rotate about respective pivots 24 such that upward movement of first ends 22 of actuator levers 21 results in downward movement of second ends 27 of actuator levers 21, and vice versa. Movement of the operator handle of electrical breaker 2 is effected in a direction opposite movement of slide plate 10. More specifically, as slide plate 10 is raised, the operator handle of electrical breaker 2 is pivoted down and as slide plate 10 is lowered, the operator handle of electrical breaker 2 is pivoted upward.

Crank arm 30 is configured to engage slide plate 10 such that rotational movement of crank arm 30 causes slide plate 10 to move linearly along its axis. In turn, movement of slide plate 10 along the axis causes actuator levers 21 to rotate about respective pivots 24 to actuate electrical breaker 2 (shown in FIG. 2) between an on position and an off position. Crank arm 30 may be rotated by applying a force to a handle 50 connected to the same shaft 40 as crank arm 30. Crank arm 30 is connected to shaft 40 at a rear end 41 of shaft 40. Crank arm 30 rotates with shaft 40. Crank arm 30 includes a crank pin 31 positioned away from shaft 40 such that rotation of shaft 40 causes crank pin 31 to move along a circular path about shaft 40. Crank pin 31 is positioned within the elongate slot 11 of slide plate 10. As crank pin 31 travels along the circular path, the lateral position of crank pin 31 within the elongate slot 11 varies and crank pin 31 exerts either an upward or a downward force upon slide plate 10. More specifically, the position of crank pin 31 within elongate slot 11 during its rotation is dependent upon the lateral distance of crank pin 31 from shaft 40 as crank pin 31 moves along its circular path. The position of slide plate 10 is determined by the vertical distance of crank pin 31 from shaft 40.

Handle 50 forms a lever with a knob 51 at one end. Handle 50 is connected to shaft 40 at a front end 42 of shaft 40. Shaft 40 rotates with movement of handle 50. Handle 50 provides a mechanical advantage proportional to its length to help overcome the spring force present in electrical breaker 2. In operation, an operator may push knob 51 in one direction, such as upward, to actuate electrical breaker 2 from its off position to its on position. The operator may push knob 51 in the opposite direction, such as downward, to actuate electrical breaker 2 from its on position to its off position. Handle 50 may include a tripped position between the on position and off position. Handle 50 may include a lock arm 52 with a lock aperture 53 (shown in FIG. 4).

FIG. 2 shows a front view of breaker rear side actuator 1 installed on an electrical breaker 2. FIG. 4 shows a bottom view of breaker rear side actuator 1 without electrical breaker 2 shown. As shown, breaker rear side actuator 1 may include a riser plate 60, a base plate 70, and a lockout bar 80. Base plate 70 may serve to mount the entire assembly 1 to an enclosure 3 (shown in FIG. 3) or panel that the unit is installed in. Riser plate 60 may serve as a mounting surface for electrical breaker 2 and/or pivot mounts 20. As shown, flanged ends 26 of pivot mounts 20 are mounted to riser plate 60. In some embodiments, pivot mounts 20 are integral to riser plate 60.

Riser plate 60 includes a crank cutout 61. Crank pin 31 of crank arm 30 extends through cutout 61 and into the elongate slot 11 of slide plate 10. Crank cutout 61 is of at least sufficient size to accommodate the movement of crank pin 31 along its circular path. Riser plate 60 also includes lever cutouts 62. First ends 22 (shown in FIGS. 1 and 4) of actuator levers 21 extend through lever cutouts 62 to connect to drive plate 23 and engage slide plate 10. Rectangular opening 25 of drive plate 23 receives the operator handle of electrical breaker 2. The axis of rotation of the operator handle of electrical breaker 2 is parallel to the axis of rotation of actuator levers 21 about the pivots 24 (shown in FIG. 4).

Figure 3:
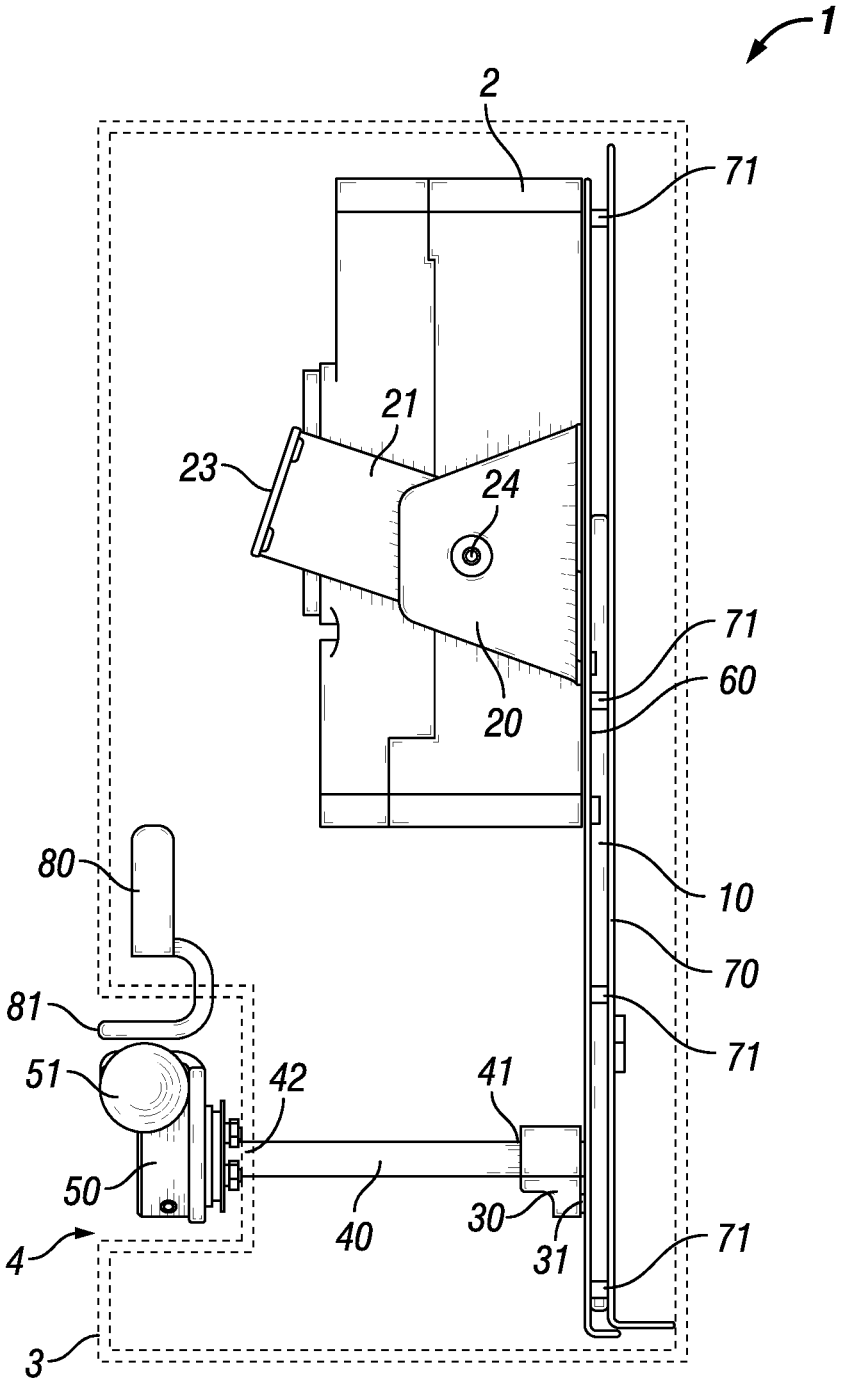
FIG. 3 shows a side view of the FIG. 2 breaker rear side actuator.
Figure 4:
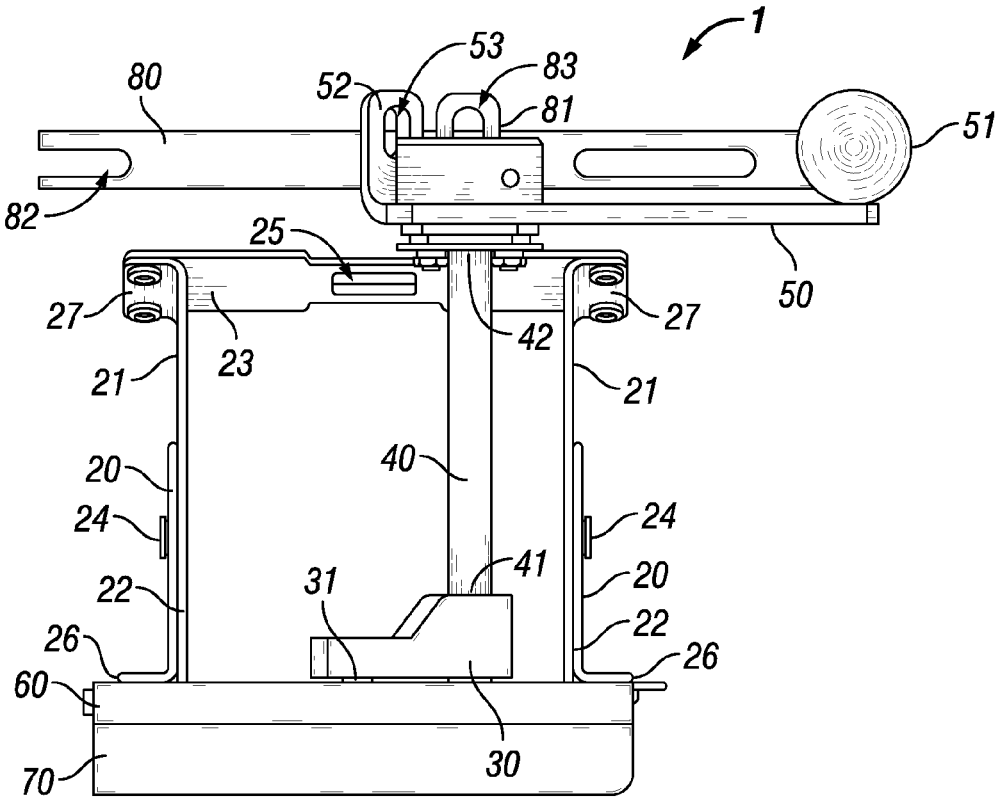
FIG. 4 shows a bottom view of the FIG. 2 breaker rear side actuator.

Lockout bar 80 is slidably connected to enclosure 3 (shown in FIG. 3). Lockout bar 80 is configured to lock electrical breaker 2 in the off position. Lockout bar 80 includes a lock arm 81 extending towards handle 50. Lock arm 52 of handle 50 extends at an angle. Lock aperture 53 (shown in FIG. 4) of lock arm 52 of handle 50 may align with lock aperture 83 of lock arm 81 of lockout bar 80 when electrical breaker 2 is in the off position. The angle of lock arm 52 may be configured to facilitate alignment of lock aperture 53 of handle 50 with lock aperture 83 of lockout bar 80 only when electrical breaker 2 is in the off position. When electrical breaker 2 is in the on position, handle 50 is rotated as shown in FIG. 2 and lock arm 52 is thereby out of alignment with lock arm 81 of lockout bar 80. Therefore, electrical breaker 2 cannot be locked in the on position using lockout bar 80. Lockout bar 80 may be configured to engage the edge of enclosure 3 (shown in FIG. 3) and the door of enclosure 3.

FIG. 3 shows a side view of breaker rear side actuator 1. Slide plate 10 is located between base plate 70 and riser plate 60. Slide plate 10 "floats" in between base plate 70 and riser plate 60. This floating action allows easy linear movement of slide plate 10. Base plate 70 and riser plate 60 have standoff mounting pins 71 that keep the distance between base plate 70 and riser plate 60 fixed. Base plate 70, riser plate 60 and mounting pins 71 may guide slide plate 10 and allow its proper freedom of movement. Base plate 70 and riser plate 60 may also have side and top guide flanges (not shown) that in conjunction with mounting pins 71 constrain the sideways and vertical movement of slide plate 10.

The breaker rear side actuator 1 may include an enclosure 3 (shown in cross-section for illustration purposes). Enclosure 3 may include a recess 4. Recess 4 of enclosure 3 may extend along only a portion of the front of enclosure 3. Lockout bar 80 is slidably mounted to enclosure 3. Lock arm 81 of lockout bar 80 may extend through enclosure 3 and into recess 4. Handle 50 and knob 51 are positioned outside enclosure 3. Handle 50 may be positioned within recess 4 of enclosure 3. Front end 42 of shaft 40 is connected to handle 50 and extends through enclosure 3 and into recess 4. Rear end 41 of shaft 40, crank arm 30, pivot mounts 20, actuator arms 21, drive plate 23, and electrical breaker 2 are positioned within enclosure 3.

Figure 5:
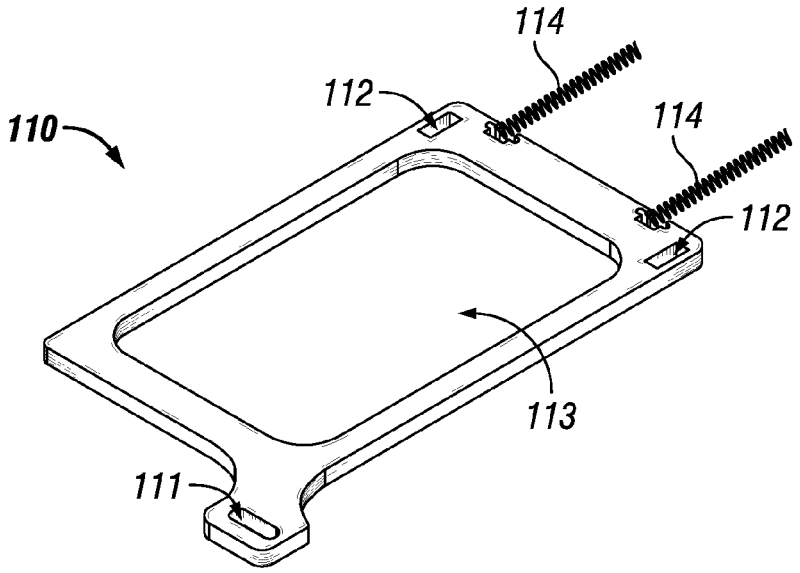
FIG. 5 shows another embodiment of a slide plate.

FIG. 5 shows an embodiment of a slide plate 110. Slide plate 110 may be used in place of slide plate 10 as would be appreciated by one of ordinary skill having the benefit of this disclosure. Slide plate 110 includes an elongate slot 111 and at least one lever aperture 112. The elongate slot 111 extends approximately normal to the linear movement of slide plate 110. Elongate slot 111 is configured to receive crank pin 31 to create a bell crank motion between crank arm 30 and slide plate 110. Slide plate 110 may include two lever apertures 112 positioned on opposite sides of slide plate 110. The two lever apertures 112 may be symmetrically positioned. Lever apertures 112 are shaped to receive a portion of actuator levers 21 therein.

As may be appreciated by the differences between slide plate 10 and slide plate 110, elongate slot 111 of slide plate 110 is positioned outward from lever apertures 112 compared to elongate slot 11 of slide plate 10 positioned inward from lever apertures 12. The position of elongate slot 111 and the distance of crank pin 31 of crank arm 30 from shaft 40 (shown in FIG. 1) can be selected depending on the amount of force desired to overcome the spring force of electrical breaker 2 (shown in FIG. 1) or the desired position above or below electrical breaker 2 in its associated enclosure 3 (shown in FIG. 3) or panel. Consequently, if using slide plate 110, then crank arm 30 would be longer than shown in FIGS. 1-4. Also, the position of crank cutout 61 would shift closer to the periphery of riser plate 60 to accommodate the shifted position of crank pin 31.

Slide plate 110 may include at least one spring 114. The at least one spring 114 may be a plurality of springs 114. The at least one spring 114 is connected to slide plate 110 and may be pinned to base plate 70 (shown in FIGS. 2 and 3). The at least one spring 114 is in a neutral state when electrical breaker 2 is in an off position. When electrical breaker 2 is in the on position, the springs 114 are stretched. However, the stored energy of springs alone is not enough to move slide plate 110. In the event that electrical breaker 2 is tripped, springs 114 assist in shifting the sliding plate 110 from the on position to the tripped position.

Referring collectively to FIGS. 1-4, an embodiment of a method for operating breaker rear side actuator 1 is described as follows. If electrical breaker 2 is in the on position (shown in FIG. 1) and it is desired to turn electrical breaker 2 off, then the operator presses down on knob 51 and the sequence of motion of electrical breaker 2 rear side actuator 1 is as follows. Assuming electrical breaker 2 is in the off position and it is desired to turn electrical breaker 2 on, the operator begins by pushing up on knob 51 of handle 50 and the following direction of motions are all reversed. The upward motion on knob 51 is transferred through the lever arm of handle 50. Handle 50 in conjunction with shaft 40 turns the upward motion of handle 50 into a rotating motion of shaft 40.

Crank arm 30 rotates with shaft 40. Crank pin 31 of crank arm 30 works in conjunction with slide plate 10 to create a bell crank motion to change the rotating motion of shaft 40 to the linear motion of slide plate 10. Crank pin 31 engages the elongate slot 11 in slide plate 10. This slot 11 allows crank pin 31 to move in a slight circular path while pushing up on slide plate 10 to turn off electrical breaker 2.

Slide plate 10 functions to transfer its linear motion evenly to first ends 22 of actuator levers 21. As slide plate 10 moves linearly, first ends 22 of actuator levers 21 are carried with slide plate 10 and cause actuator levers 21 to rotate about respective pivots 24 on pivot mounts 20. The two actuator levers 21 may provide a symmetrical motion and force that is transmitted evenly to drive plate 23 at second ends 27 of actuator levers 21. As the two actuator levers 21 rotate about respective pivots 24 of pivot mounts 20, drive plate 23 is carried with the two actuator levers 21. The operator handle of electrical breaker 2 is positioned within opening 25 of drive plate 23 and moves with drive plate 23, thereby causing electrical breaker 2 to switch from its on position to its off position as the two actuator levers 21 rotate about respective pivots 24.

If the operator chooses to lock out electrical breaker 2 rear actuator 1, then he can slide lockout bar 80 to the side. A vertical portion of lockout bar 80 may engage the edge of enclosure 3 and lock the door of enclosure 3. A profile 82 may serve as a point of slidable attachment for lockout bar 80 to enclosure 3. Additionally, an operator may install a padlock, or other restraint, through lock aperture 83 on lock arm 81 of lockout bar 80 and lock aperture 53 on lock arm 52 of handle 50. With the padlock in place, rotation of handle 50 is inhibited.

One embodiment of a method for operating an electrical breaker 2 includes sliding a slide plate 10 within a plane of slide plate 10 behind an electrical breaker 2 from a first position to a second position. An actuator lever 21 engages slide plate 10. The method includes rotating actuator lever 21 about a pivot from a first position to a second position as actuated by slide plate 10 sliding, actuator lever 21 engaging a drive plate 23 in front of electrical breaker 2. The method includes moving drive plate 23 from an off position to an on position as actuated by actuator lever 21 rotating. The actuator lever 21 may be two actuator levers 21. Drive plate 23 engages an operator handle of electrical breaker 2. The method includes turning electrical breaker 2 on as a result of slide plate 10 sliding. Electrical breaker 2 may be positioned between slide plate 10 and drive plate 23.

The method may include moving slide plate 10 from its second position to its first position, rotating actuator levers 21 about respective pivots 24 from their second position to their first position as actuated by the linear movement of slide plate 10 from its second position to its first position, and moving drive plate 23 from its on position to its off position as actuated by the rotational motion of actuator levers 21 about respective pivots 24 from their second position to their first position. The method may include rotating crank arm 30 about an axis of rotation, such as shaft 40, and moving crank pin 31 in a circular motion around the axis of rotation. The method may include engaging elongate slot 11 of slide plate 10 with crank pin 31 and moving slide plate 10 linearly from its first position to its second position as actuated by the circular motion of crank pin 31.

Another embodiment of a method of actuating an electrical breaker 2 from an off position to an on position includes moving a slide plate 10 from a first position to a second position. A pair of actuator levers 21 pivot about their respective pivots 24 due to engagement with slide plate 10. The pivotal motion of actuator levers 21 connected to an operator handle of an electrical breaker 2 causes a switch of electrical breaker 2 to move from an off position to an on position. The method may include moving slide plate 10 linearly from its second position to its first position, rotating the two actuator levers 21 about respective pivots 24 due to engagement with slide plate 10, and switching electrical breaker 2 from its on position to its off position by the rotational motion of the two actuator levers 21. The method may include rotating crank arm 30 about an axis of rotation, such as shaft 40, and moving crank pin 31 in a circular motion around the axis of rotation. The method may include engaging elongate slot 11 of slide plate 10 with crank pin 31 and moving slide plate 10 linearly from its first position to its second position as actuated by the circular motion of crank pin 31.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGS.

| | |
|---|---|
| 1 | Breaker rear side actuator |
| 2 | Breaker |
| 3 | Enclosure |
| 4 | Recess |
| 10 | Slide Plate |
| 11 | Elongate aperture |
| 12 | Lever aperture |
| 13 | Middle opening |
| 20 | Pivot mount |
| 21 | Actuator lever |
| 22 | First end |
| 23 | Drive plate |
| 24 | Pivot |
| 25 | Rectangular opening |
| 26 | Flanged end |
| 27 | Second end |
| 30 | Crank arm |
| 31 | Crank pin |
| 40 | Shaft |
| 41 | Rear end |
| 42 | Front end |
| 50 | Handle |
| 51 | Knob |

-continued

TABLE OF REFERENCE NUMERALS FOR FIGS.

| | |
|---|---|
| 52 | Lock arm |
| 53 | Lock aperture |
| 60 | Riser plate |
| 61 | Crank cutout |
| 62 | Lever cutout |
| 70 | Base plate |
| 71 | Standoffs |
| 80 | Lockout bar |
| 81 | Lock arm |
| 82 | Profile |
| 83 | Lock aperture |
| 110 | Slide Plate |
| 111 | Elongate aperture |
| 112 | Lever aperture |
| 113 | Middle opening |
| 114 | Spring |

What is claimed is:

1. A breaker rear side actuator, the actuator comprising:

a slide plate being linearly movable between a first position and a second position;

at least one actuator lever having a first end and a second end, the at least one actuator lever being rotatable about a pivot positioned between the first end and the second end, the first end of the at least one actuator lever engaging the slide plate at a first position offset from the pivot, and rotational movement of the at least one actuator lever being actuatable by linear movement of the slide plate; and a drive plate engaging the second end of the at least one actuator lever at a second position offset from the pivot and being configured to engage an operator handle of an electrical breaker, the drive plate being moveable between an off position and an on position and being actuatable by rotational motion of the at least one actuator lever.

2. The actuator of claim 1, wherein the at least one actuator lever comprises two actuator levers, each of the two actuator levers engaging the drive plate.

3. The actuator of claim 1, further comprising a base plate and a riser plate, both being different from the actuator lever, wherein the slide plate is positioned between the base plate and the riser plate.

4. A breaker rear side actuator, the actuator comprising:

a slide plate being linearly movable between a first position and a second position, the slide plate including an elongate slot extending approximately normal to the linear movement of the slide plate;

at least one actuator lever, the at least one actuator lever being rotatable about a pivot, the at least one actuator lever engaging the slide plate, and rotational movement of the at least one actuator lever being actuatable by linear movement of the slide plate;

a drive plate engaging the at least one actuator lever and being configured to engage an operator handle of an electrical breaker, the drive plate being moveable between an off position and an on position and being actuatable by rotational motion of the at least one actuator lever; and a rotatable crank arm with a crank pin, the crank pin being positioned within the elongate slot.

5. The actuator of claim 4, further comprising:

a shaft having a first end and a second end, the crank arm being connected to and rotatable with the first end of the shaft; and a handle connected to and rotatable with the second end of the shaft.

6. A breaker rear side actuator, the actuator comprising:

an electrical breaker having a first side, a second side different from the first side, and an operator handle on the first side;

a slide plate being linearly movable between a first position and a second position, the slide plate being positioned on the second side of the electrical breaker;

at least one actuator lever, the at least one actuator lever being rotatable about a pivot, the at least one actuator lever engaging the slide plate and being connected to the operator handle of the electrical breaker, rotational movement of the at least one actuator lever being actuatable by linear movement of the slide plate.

7. The actuator of claim 6, wherein the second side is opposite the first side.

8. The actuator of claim 7, wherein the at least one actuator lever comprises two actuator levers, each of the two actuator levers engaging the drive plate.

9. The actuator of claim 7, further comprising a drive plate engaging the operator handle of the electrical breaker, the at least one actuator lever being connected to the operator handle through the drive plate.

10. The actuator of claim 7, wherein the slide plate includes an elongate slot extending approximately normal to the linear movement of the slide plate and the actuator further comprises a rotatable crank arm with a crank pin, the crank pin being positioned within the elongate slot.

11. The actuator of claim 10, further comprising:

a shaft having a first end and a second end, the crank arm being connected to and rotatable with the first end of the shaft; and a handle connected to and rotatable with the second end of the shaft.

12. The actuator of claim 6, further comprising a base plate and a riser plate, both being different from the actuator lever, wherein the slide plate is positioned between the base plate and the riser plate.

13. A method for actuating a breaker, the method comprising:

moving a slide plate linearly from a first position to a second position;

providing at least one actuator lever having a first end, a second end, and a pivot positioned between the first end and the second end;

engaging the first end of the at least one actuator lever with the slide plate at a first position offset from the pivot, the at least one actuator lever rotating about the pivot from a first position to a second position as actuated by the linear movement of the slide plate; and engaging a drive plate in front of an electrical breaker with the second end of the at least one actuator lever at a second position offset from the pivot, the drive plate moving from an off position to an on position as actuated by the rotational motion of the at least one actuator lever.

14. The method of claim 13, wherein the electrical breaker is positioned between the slide plate and the drive plate.

15. The method of claim 13, further comprising:

moving the slide plate linearly from the second position to the first position;

rotating the at least one actuator lever about the pivot from the second position to the first position as actuated by the linear movement of the slide plate from the second position to the first position; and moving the drive plate from the on position to the off position as actuated by the rotational motion of the actuator lever from the second position to the first position.

16. The method of claim 13, wherein the at least one actuator lever comprises two actuator levers, each of the two actuator levers engaging the drive plate.

17. A method for actuating a breaker, the method comprising:

rotating a crank arm about an axis of rotation, the crank arm including a crank pin moving in a circular motion around the axis of rotation;

engaging an elongate slot of a slide plate with the crank pin, the slide plate moving linearly from a first position to a second position as actuated by the circular motion of the crank pin;

engaging at least one actuator lever with the slide plate, the at least one actuator lever rotating about a pivot from a first position to a second position as actuated by the linear movement of the slide plate; and engaging a drive plate in front of an electrical breaker with the at least one actuator lever, the drive plate moving from an off position to an on position as actuated by the rotational motion of the at least one actuator lever.

18. A method for actuating a breaker, the method comprising:

providing an electrical breaker having a first side, a second side different from the first side, and an operator handle on the first side;

moving a slide plate linearly from a first position to a second position, the slide plate being positioned on the second side of the electrical breaker;

rotating two actuator levers about respective pivots due to engagement with the slide plate, the two actuator levers being connected to the operator handle of the electrical breaker; and switching the electrical breaker from an off position to an on position by the rotational motion of the two actuator levers.

19. The method of claim 18, further comprising:

moving the slide plate linearly from the second position to the first position;

rotating the two actuator levers about the respective pivots due to engagement with the slide plate; and switching the electrical breaker from the on position to the off position by the rotational motion of the two actuator levers.

20. The method of claim 18, further comprising:

rotating a crank arm about an axis of rotation, the crank arm including a crank pin moving in a circular motion around the axis of rotation; and engaging an elongate slot of the slide plate with the crank pin, the slide plate moving linearly from the first position to the second position as actuated by the circular motion of the crank pin.

* * * * *